US006780351B2

(12) United States Patent
Wirth, Jr.

(10) Patent No.: US 6,780,351 B2
(45) Date of Patent: Aug. 24, 2004

(54) VESSEL INSPECTION AND REPAIR SYSTEM

(76) Inventor: Emil J. Wirth, Jr., 19720 Mustang Dr., Dunnelleon, FL (US) 34432

( * ) Notice: Subject to any disclaimer, the term of this patent is extended or adjusted under 35 U.S.C. 154(b) by 16 days.

(21) Appl. No.: 09/843,740

(22) Filed: Apr. 30, 2001

(65) Prior Publication Data

US 2002/0158368 A1 Oct. 31, 2002

(51) Int. Cl.[7] ..... F27D 1/16

(52) U.S. Cl. ..... 264/30; 118/663; 264/36.15; 266/281; 700/283

(58) Field of Search ..... 264/30, 36.1, 36.15, 264/309; 266/281, DIG. 1; 425/13; 29/402.18; 700/194, 195, 253, 283; 118/696, 663

(56) References Cited

U.S. PATENT DOCUMENTS

| | | | | | |
|---|---|---|---|---|---|
| 3,663,669 | A | * | 5/1972 | McConnell | 264/30 |
| 3,716,316 | A | * | 2/1973 | Dekker et al. | 425/13 |
| 4,107,244 | A | | 8/1978 | Ochiai et al. | 264/30 |
| 4,218,989 | A | | 8/1980 | Fujita et al. | 118/713 |
| 4,248,809 | A | | 2/1981 | Sakai et al. | 264/30 |
| 4,541,971 | A | | 9/1985 | Takashima | 264/30 |
| 4,649,858 | A | | 3/1987 | Sakai et al. | 118/697 |
| 4,708,482 | A | | 11/1987 | Neiheisel | 356/602 |
| 4,893,933 | A | | 1/1990 | Neiheisel et al. | 356/608 |
| 5,127,736 | A | | 7/1992 | Neiheisel | 356/602 |
| 5,212,738 | A | | 5/1993 | Chande et al. | 382/152 |
| 5,546,176 | A | | 8/1996 | Jokinen | 356/5.1 |
| 5,570,185 | A | | 10/1996 | Jokinen et al. | 356/601 |
| 5,594,548 | A | | 1/1997 | Kobayashi et al. | 356/602 |
| 5,628,940 | A | * | 5/1997 | Allison | 264/30 |
| 5,745,969 | A | | 5/1998 | Yamada et al. | 29/402.18 |
| 5,886,775 | A | | 3/1999 | Houser et al. | 356/4.01 |
| 5,966,308 | A | * | 10/1999 | Kazirskis et al. | 700/195 |
| 6,074,194 | A | | 6/2000 | McHugh | 425/447 |
| 6,297,844 | B1 | | 10/2001 | Schatz et al. | 348/43 |
| 6,402,707 | B1 | | 6/2002 | Ernst | 600/590 |

* cited by examiner

*Primary Examiner*—Joseph Drodge
*Assistant Examiner*—Emmanuel Luk

(57) ABSTRACT

The disclosed methods and systems for inspecting and repairing vessels include a laser used to project a laser beam into a hot furnace or vessel, a laser reader to measure a point cloud formed when the laser light reflects from the wall of the furnace, means for selecting those points in the cloud that are more relevant, and using the points to produce a 3D image that corresponds to the geometry of the interior of the furnace or vessel. The disclosed systems and methods further include means for comparing the 3D geometric data corresponding to the interior of the vessel with 3D geometric data provided as a reference, generating a 3D repair trace based on the comparison, and controlling a spray gun for applying refractory material according to the trace by taking into account a set of physical variables related to the vessel and the refractory material.

11 Claims, 6 Drawing Sheets

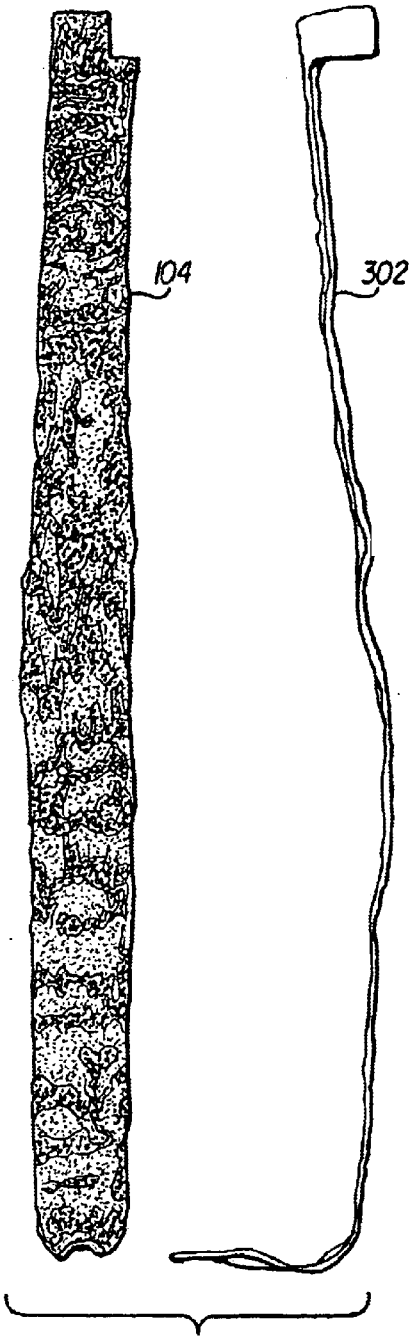
FIG. 3
FIG. 4
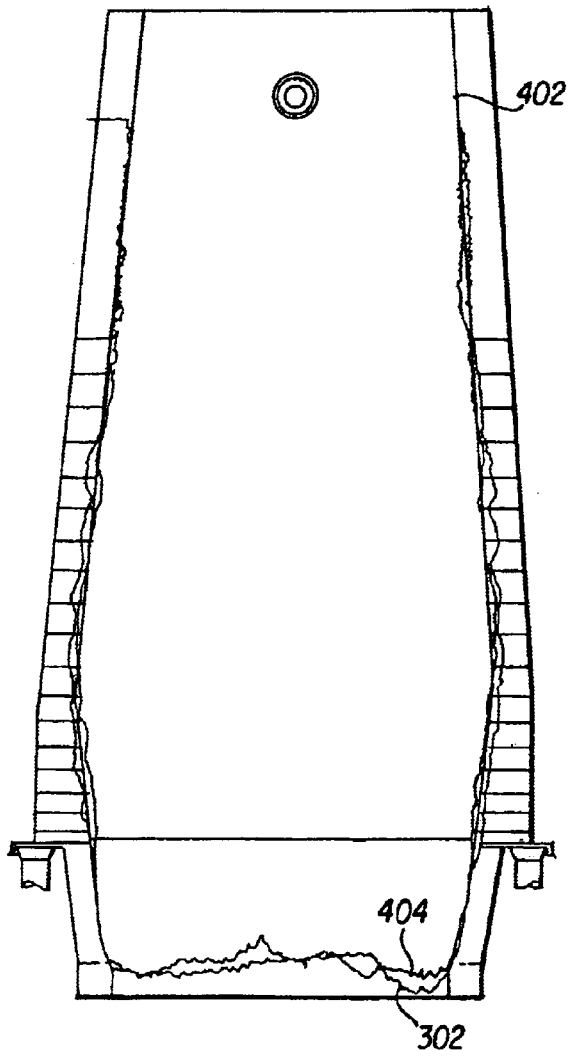

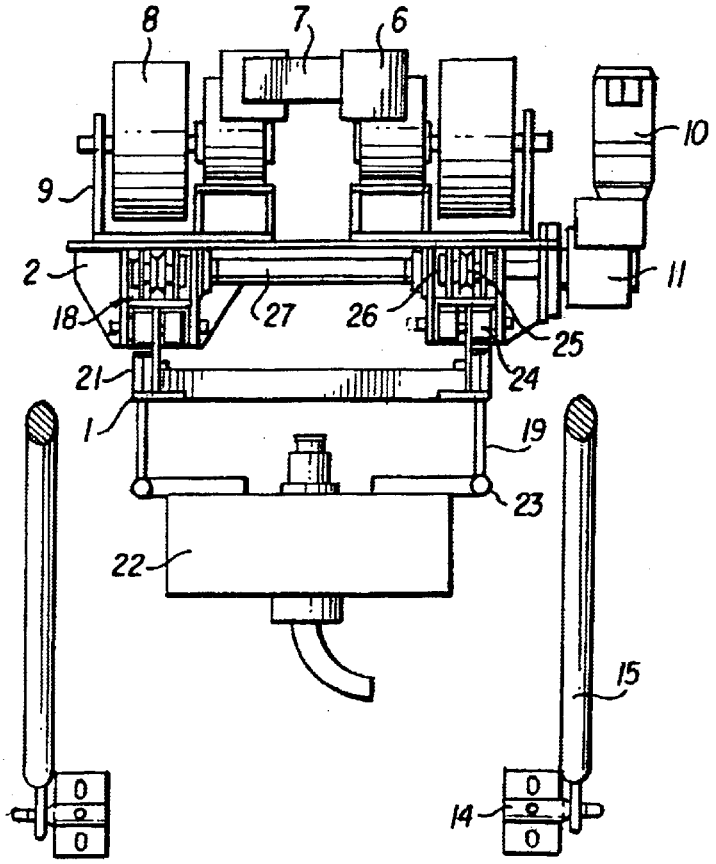
FIG. 6
FIG. 7
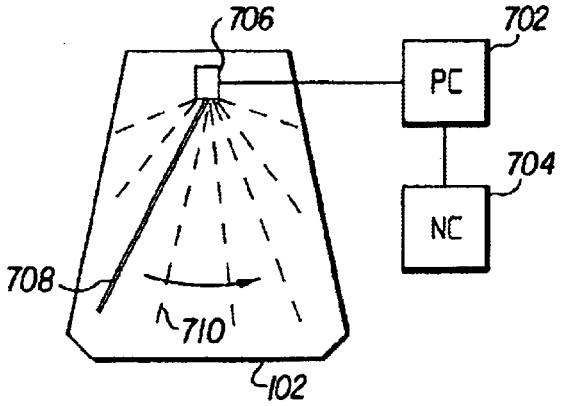
FIG. 8
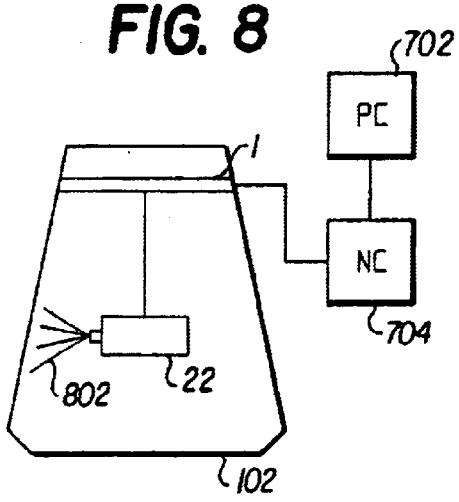

VESSEL INSPECTION AND REPAIR SYSTEM

BACKGROUND OF THE INVENTION

1. Field of the Invention

The present invention relates to a system for remotely measuring the thickness of vessel linings by using digital data imaging. The invention may be used to inspect and repair the interior of refractory-lined vessels or furnaces such as those used in metallurgical processing and other applications.

2. Description of Related Art

The walls of steel furnaces and other vessels used in steel and metal making are typically covered by refractory linings made of bricks. For example, a basic furnace (BOF) for steel making is typically formed from three shells: an inner working lining of bricks, a middle safety lining also of bricks, and an outer shell usually of steel. The inner and working linings together are usually about three feet thick. The working lining undergoes uncontrolled and unpredictable wear during steel processing. Consequently, in order to maintain safe and economical production rates, the linings must be periodically inspected to ascertain their remaining thickness.

Among the systems currently available for measuring the linings of such vessels are those described in U.S. Pat. No. 5,212,738 to Chande et al., and in U.S. Pat. No. 5,127,736 to Nehisel. Chande et al. teaches a laser scanning system that determines the thickness of an object, such as the interior of a furnace. The thickness is determined by first measuring the distance between the object and an imaging device (i.e., laser), and then comparing the measured distance with a predetermined mathematical model of the object.

Neiheisel teaches an apparatus that directs a continuous wave laser beam light at the refractory lining within a furnace vessel, and the displacement, as measured by a self-scanned linear array of the scattered light beam from a nominal or reference position, is measured to provide an indication of lining wear or damage. The video signal received by the linear array receiver provides information for mapping the worn or damaged areas of the vessel lining so that such areas may be repaired by a gunning spray nozzle operated manually.

Among the systems currently available for repairing the linings undergoing wear are those described in U.S. Pat. No. 4,107,244 to Ochiai et al. and U.S. Pat. No. 4,218,989 to Fujita et al. Ochiai et al. disclose a method for transmitting microwaves into the surface of a heated refractory lining in a vessel, detecting the waves reflected from the surface, detecting the difference between the reference surface of the refractory lining and the damaged surface from the phase difference of the microwaves, controlling the transfer of the refractory gunning nozzle inserted into the vessel with the use of the deviation signal, and making the lining repair in the hot atmosphere. The steps related to inspection of the vessel are carried out separately from the steps related to repair of the vessel.

Fujita et al. disclose an apparatus for applying refractory material that includes a TV camera at a desired position on a spray pipe and a monitoring device which is located outside of a furnace. The TV camera has a visual range directed towards the same direction as that of the spray nozzle, so that an operator of the spray nozzle can accordingly conduct a considerably accurate and safe lining operation.

The present invention represents an improvement over the systems in the prior art in that it is an automated solution to the problem of inspecting and repairing vessels, and thus, does not require the supervision of a human operator at the time of repair. Further, the present invention does not require the use of programmable logic controllers (PLCs) as part of the repair mechanism. Further, the inspection mechanism of the present invention does not require the use of each and every coordinate or point in space that is read from a point cloud reflected from the interior of the vessel. Still further, the present invention incorporates a numerical controller for controlling the refractory material spray gun, which allows for precise spraying of the repair material and thus avoids waste of the material and saves time. Finally, the image of the interior of a vessel is produced in 3-D (as opposed to 2½D) which also enables the precise spraying of the material, thus saving time.

SUMMARY AND OBJECTS OF THE INVENTION

Methods and systems for inspecting and repairing vessel systems are disclosed. Specifically, such methods and systems include a laser used to project laser light into a hot furnace or vessel, a laser reader to measure a point cloud formed when the laser light reflects from the wall of the furnace, means for selecting those points in the cloud that are more relevant, and using the points to produce a 3D image that corresponds to the geometry of the interior of the furnace or vessel.

Such systems and methods further include means for comparing the 3D geometric data corresponding to the interior of the vessel with 3D geometric data provided as a reference, generating a 3D repair trace based on the comparison, and controlling a spray gun for applying refractory material according to the trace by taking into account a set of physical variables related to the vessel and the refractory material.

It is an object of the present invention to provide a fully automated solution to the problem of inspecting and repairing vessels, and thus, significantly reducing the need of human supervision at the time of repair. It is another object of the present invention to more efficiently read a laser cloud to generate a 3D geometry of the interior of a vessel. It is another object of the invention to minimize the waste of refractory material when applied to the interior walls of a vessel. It is another object of the invention to produce a 3D image (as opposed to 2½D) of the interior of a vessel to enable the precise spraying of the refractory material, thus saving time and eliminating the need to carry out the operation during the day.

With these and other objects, advantages and features of the invention that may become hereinafter apparent, the nature of the invention may be more clearly understood by reference to the following detailed description of the invention, the appended claims and to the several drawings attached herein.

BRIEF DESCRIPTION OF THE DRAWINGS

The preferred embodiments of this invention will be described in detail, with reference to the following figures, wherein:

FIG. 3 illustrates a 3D image of a section of the interior walls of a vessel produced by the inspection system of the present invention;

FIG. 4 illustrates a 2D image of a vessel having a trace corresponding to the amount of refractory material that needs to be added;

FIG. 6 illustrates a second schematic view of a JIB used for carrying a refractory material spray gun and support equipment into the vessel;

FIG. 7 illustrates one embodiment of the inspection system of the present invention;

FIG. 8 illustrates one embodiment of the repair system of the present invention;

DETAILED DESCRIPTION OF THE INVENTION

Figure 1:
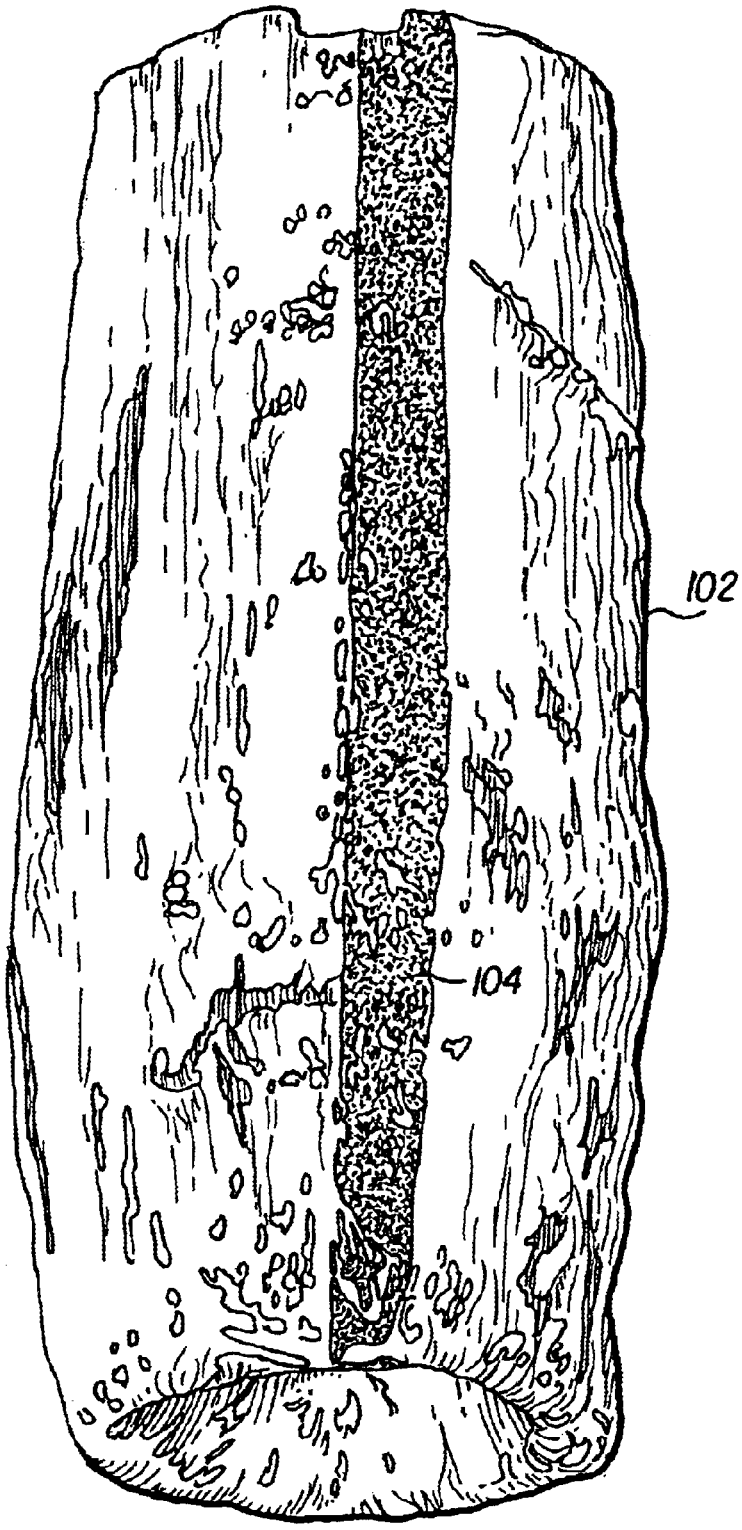
FIG. 1 illustrates a first 3D image of the exterior walls of a vessel produced by the inspection system of the present invention.

FIG. 1 illustrates a 3D image of the exterior walls of a vessel 102 produced by the inspection system of the present invention. Unlike inspection systems in the prior art which produce 2½D images of vessels, the present invention produces a 3D image. The 3D image is produced by a computer, as will be discussed later.

The image of vessel 102 may be divided into sections, for example, section 104 in FIG. 1. Dividing the vessel image into sections may simplify the repair process by only focusing on a given section of the vessel at a time.

Figure 2:
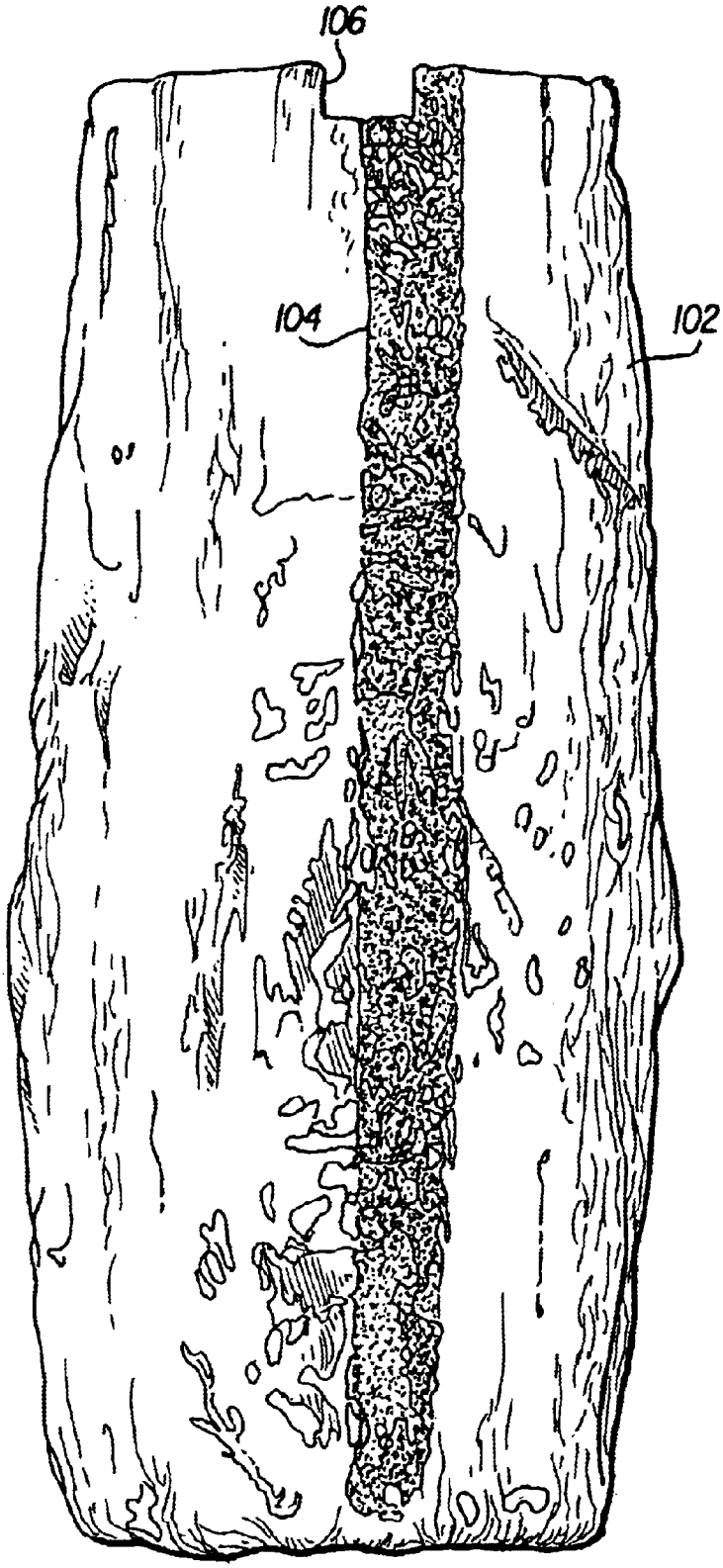
FIG. 2 illustrates a second 3D image of the exterior walls of a vessel produced by the inspection system of the present invention.

FIG. 2 illustrates a second 3D image of the exterior walls of the vessel 102 produced by the inspection system of the present invention. FIG. 2 more clearly shows an opening 106 through which the inspection and repair systems of the present invention are inserted in order to gain access to the interior of the vessel 102.

FIG. 3 illustrates a 3D image of the section 104 of the interior walls of the vessel 102 produced by the inspection system of the present invention. FIG. 3 also includes a side view 302 of the section 104. The side view 302 shows the current state of the interior wall of the vessel, which is later compared to a side view of the section 104 before its wear. Alternatively, it may be compared with an image used as a reference so that the repair system of the present invention can compute the difference between the two and apply refractory material to the section 104 so that its image, after the application of the refractory material, matches the reference image.

FIG. 4 illustrates a 2D image of a vessel. Trace 402 represents the vessel depicted from customer-supplied mill drawings drawn to scale. Trace 302 corresponds to the preliminary point cloud data acquisition prior to any material being applied to the interior walls, which is compared with trace 402 to allow the vessel wear to be evaluated. Trace 404 represents the accumulated point cloud data taken after the refractory material has been applied, illustrating the measurable results of the present invention.

Figure 5:
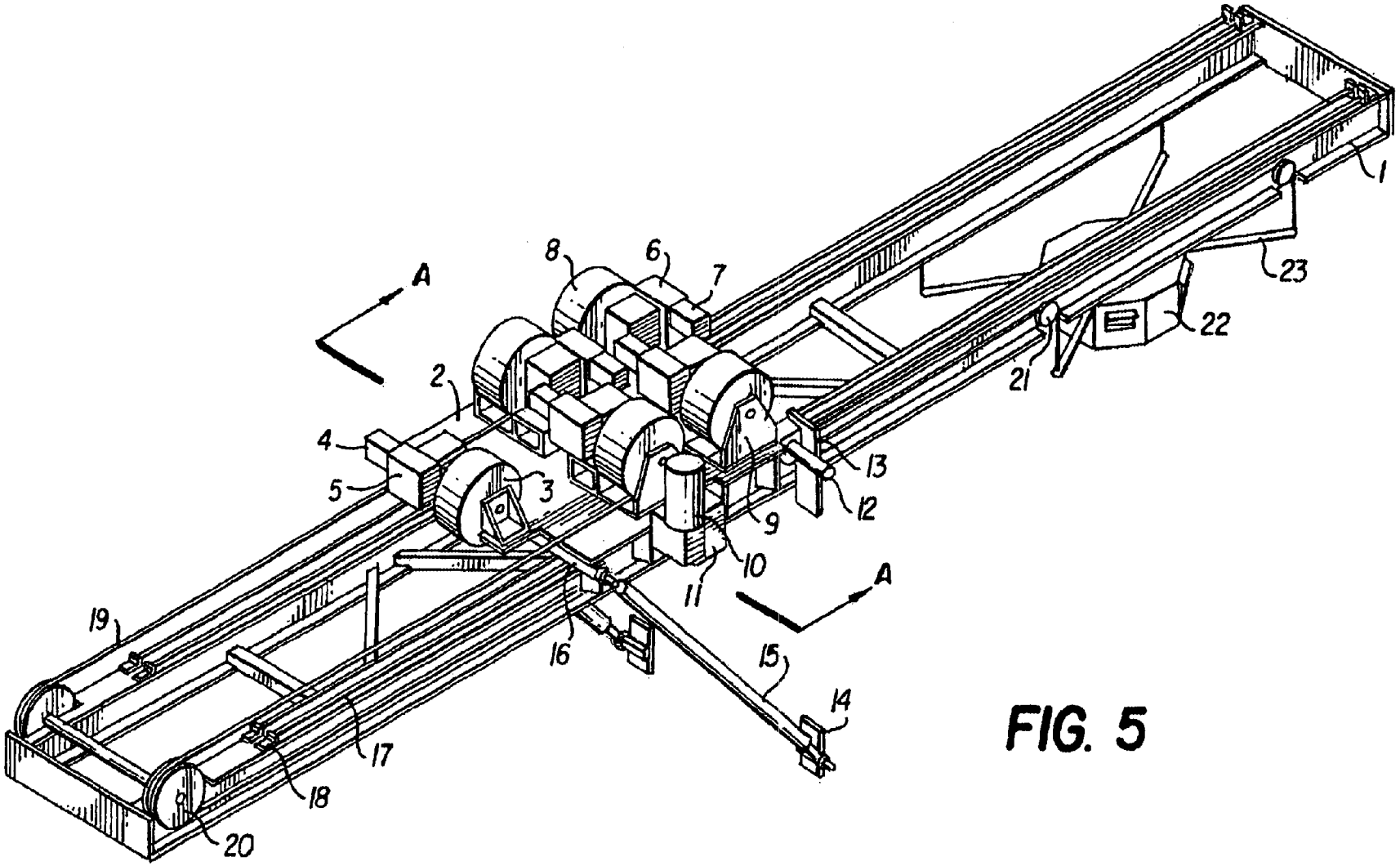
FIG. 5 illustrates a first schematic view of a JIB used for carrying a refractory material spray gun and support equipment into the vessel.

FIGS. 5 and 6 are illustrative views of the travelling support beam assembly, also referred to as the "JIB". The JIB is attached to, and moves in and out of the vessel 102 to suspend the ADRAM unit 22 and other support equipment. The ADRAM unit 22 is used for applying refractory material to the vessel walls as part of the repair process.

The hoist mount and beam support deck assembly 2 provide a base to which the hoisting assemblies 9, beam assembly 1, and vessel mounting (13, 14) are secured to. The auxiliary hoist cable drum 3 supplies a spare hoist cable for the main hoist cables and support equipment. The auxiliary hoist motor 4 is used to drive the auxiliary hoist gear reducer 5. The auxiliary hoist gear reducer 5 drives the auxiliary hoist cable drum 3.

The main hoist gear reducers 6 are used to drive the main hoist cable drums 8. The main hoist motors 7 drive the main hoist gear reducers 6. The main hoist cable drums 8 supply hoist cables to suspend a portion of an ADRAM or support equipment. The main hoist mounting assemblies 9 provide a base that a main hoist cable drum and the main hoist gear reducer are secured to.

The support beam positioning motor 10 drives the beam positioner gear reducer 11. The support beam positioner gear reducer 11 positions the beam assembly 1 in the proper operation positions by using a drive shaft with sprockets attached.

The deck mounting trunnion 12 is used to attach the deck assembly 2 to the upper vessel mounting plate 13. The upper JIB unit vessel mounting plates 13 secure the JIB unit to the vessel 102. The lower JIB unit vessel mounting plates 14 secure the adjustable support arms to the vessel 102. The adjustable support arms 15 support and level the JIB unit relative to the vessel 102.

The rear support trunnions 16 attach the adjustable support arms to the deck assembly 2. The beam positioning chains 17 are attached to the beam assembly 1 to move it in the proper operating positions. The adjustable chain tension links 18 maintains the proper chain tension.

The main hoist cables 19 suspend the ADRAM unit 22 and the support equipment. The rear cable sheaves 20 allow the cable to remain in the correct location relative to the beam assembly 1. The forward cable sheaves 21 maintain the correct placement of the main hoist cables 19. The ADRAM stabilization mounts 23 help stabilize movement and attach an ADRAM unit 22 to the main hoist cables 19.

The beam support rollers 24 allow the support beam assembly to move in the deck assembly 2. The beam guide v-rollers 25 keep the support beam assembly located within the deck assembly. The beam positioning chain drive sprockets 26 move the support beam assembly using the beam positioning chains. The sprocket drive shaft 27 drives the beam positioning chain drive sprockets 26.

Turning to FIGS. 7 and 8, a description of the overall methodology of the present invention follows. The first step in the process is to project a laser 708 into the interior of a vessel 102. The arrow 710 points to the direction in which the laser moves. The laser projection results in the formation of a point cloud when the laser reflects off the interior walls of the vessel 102. A laser reader 706 is used to acquire the point cloud and send the acquired signal to Personal Computer (PC) 702. The PC 702 processes the signal to derive from it three dimensional points in space corresponding to the interior of the vessel 102. That is, the point cloud represents the dimensions of the interior of the vessel as recognized by a person of ordinary skill in the art.

Prior art systems may suggest to directly use 2½D dimensions as part of the operation of a spray gun mechanism in order to carry out the repair of the vessel. Unlike prior art systems, the present invention provides an automated solution that conducts intense image processing before proceeding with a repair operation. The image processing may be conducted by using a combination of commercially available software modules, as will be explained below.

Referring to FIG. 8, the travelling support beam assembly (with the attached ADRAM unit 22) enters the vessel 102 by being inserted through the opening 106 at the top of the vessel 102. The numerical controller (NC) 704 of the present invention controls the ADRAM unit 22 so that it rotates along the normally horizontal plane in order to apply the refractory material 802. The inner walls of the vessel 102 can be repaired completely because the ADRAM unit 22 can be moved up or down along the vertical axis so as to cover, for example, section 104 of the vessel 102. The NC 704 also controls the motors 4 and 7, which enable the movement of the ADRAM unit 22 in the vertical direction.

The method of the present invention is mainly comprised of four major steps: equipment installation, power wash of the vessel surface, vessel inspection, and vessel repair. Equipment installation has been discussed above in connection with FIGS. 5–8. Thus, the following discussion is limited to the remaining three steps.

The surface power wash refers to the cleaning of the interior walls of the vessel 102 as part of their preparation for inspection and repair. A hydro-descaler may be used to power wash the walls.

The goal of the vessel inspection step is to provide input data to PC 702, which in turn provides the configuration of the vessel interior geometry in multiple axises. The geometry information may be produced by using a combination of commercially available software modules that implement the vessel inspection steps.

The first of such modules is the LPMSCAN software package. LPMSCAN may be used to project the laser into the vessel and record the point cloud data. A person of ordinary skill in the art would recognize that projecting a laser, as shown in FIG. 7, could produce a point cloud having a resolution quality that varies depending on the angle on which the laser projects into the interior walls. The present invention may use digital photography, in addition to laser imaging, to compensate for the lack of high quality resolution points in the cloud. The program Shape Capture may be used along with a digital camera to capture the digital data. Both Shape Capture and LPMSCAN produce the same type of data, i.e., the point cloud. Thus, the point cloud produced by Shape Capture may be combined with that produced by LPMSCAN to obtain a single point cloud. Each of the methods for capturing the point cloud may be used on its own. That is, the present invention may use LPMSCAN and/or Shape Capture.

The point cloud data is converted to a stereo lithographic geometry. This data conversion may be performed by using the GEOMAGIC software package. Once the geometry is obtained, it is then translated to a data interchange format. This may be implemented by using the MASTERCAM software package. Once the stereo lithographic geometry is translated into the data interchange format, the data is then compared with the reference vessel refractory geometry. This comparison may be carried out by using the AUTOCAD software package. That is, both the reference and the acquired three-dimensional geometric data are entered into AUTOCAD (or any other software module carrying out the comparison between the two). As mentioned before, the reference data does not have to necessarily reflect the original geometry of the vessel before its wear.

Repairing the vessel is the last of the major steps in the method of the present invention. AUTOCAD may also be used as part of the vessel repair. Specifically, it may be used to establish the vessel gunning refractory parameters and to apportion all vessel areas (e.g., section 104 in FIG. 1) for the desired refractory material volumetric application by cell definition. The vessel gunning refractory requirement parameters refer to the preferred volumetric refractory material usage for each designated area or cell of the vessel, as explained later (i.e., by illustrating the use of the Visual Basic array furn_data(xfeed,cell)). The data extracted from the point cloud is compared with the reference vessel characteristics to establish the deficiencies in the vessel lining. With these deficiencies defined, corresponding matrix data is generated and stored in predefined matrices. For example, if the vessel area for a matrix position, which points towards the one inch elevation point and one degree in rotation, shows normal wear, the constant in cell 1,1 is multiplied by 100%, which when interpreted by the algorithm discussed below, the algorithm controls the application of refractory material to the vessel location correlated to cell 1,1 at a rate of one to one. Conversely, if the position of cell 1,1 shows the vessel lining to be twice as worn as anticipated, the constant in cell 1,1 is multiplied by 50% which results in the application of refractory material to the vessel location correlated to cell 1,1 at a rate of two to one. The algorithm discussed below performs the information retrieval (query) directly with the data matrix.

Repairing the vessel may also include transferring gunning cell information from AUTOCAD directly into the PC 702 memory. This facilitates mechanical positioning with location over time format. Mechanical positioning with location over time means that the movement of the spraying nozzle is controlled by location (e.g., in degrees), computed over time (e.g., in seconds) and that positioning enables precise material placement. The gunning cell information is then used by the PC 702 to control the ADRAM unit 22.

Another step in the repair process includes the integration of known vessel variables to automatically control the application of refractory material. The control methodology comprises solving volumetric requirements derived from variations in the vessel diameters and contours, material density, material transmission rates, and applied material integrated with the rate of angular movement and/or repeat pattern adjustments. All the software modules discussed above may be run on the PC 702, and that interaction between modules (e.g., data being transferred from one module into another) may be accomplished by use of the WIN 32 application programming interface as would be recognized by a person of ordinary skill in the art.

The control program is run by the NC 704 via the PC 702. The control program includes two algorithms, one for controlling the rotation rate (see arrow 801 in FIG. 8) and the other for controlling the rise rate (vertical movement indicated by arrow 802 in FIG. 8). The variation in pumping rate, as explained below, is handled with a manual feed override (MFO).

The control algorithms may use a fixed variable and a number of non-fixed variables. The fixed variable contain values that do not change along the repair process. The value of the non-fixed variables do change.

The fixed variable is the refractory material density, which may be entered in pounds per cubic foot. Two of such materials that may be used are the BLS and the RTA. Any other material with a known density may be used as well.

The non-fixed variables include the vessel diameter, the desired wall thickness, the pump rate, the rotation rate, the rise rate, and the MFO.

The vessel diameter may be entered in decimal feet. As seen from the figures, a vessel will typically have a smaller diameter at the top, which then increases as it goes down. In essence, the diameter varies with the vertical elevation.

The desired wall thickness may be entered into the program in decimal feet. The desired wall thickness may be the original wall thickness (e.g., three feet) before its wear. Alternatively, the desired wall thickness would be any thickness specified, which may differ from the original wall thickness. To facilitate this, a given section (e.g., 104 in FIG. 1) may be subdivided into cells or blocks and the desired wall thickness may be specified for a single block.

The pump rate may be entered in pounds per minute. In essence, the pump rate is the rate at which the refractory material is being applied to the walls of the vessel. The pump (not shown) which is connected to the ADRAM unit 22, may run continuously. As the pump is running, the number of pounds of material being transferred to the ADRAM unit 22 are measured per minute. That number as a practical matter will vary even if the pump is set to transfer a certain number of pounds per minute, as will be appreciated by a person of ordinary skill in the art. It is important to know the actual number of pounds per minute being transferred because it will have an effect on achieving the desired wall thickness.

The rotation rate may be entered in degrees per minute. This rate is both measured and controlled. For example, the NC 704 measures the rate and the PC 702 inputs the measured rate into a control algorithm as a variable "Rotation_AxisVelocity". The PC 702 then calculates the rate at which the ADRAM unit 22 should be rotating, and sends the desired rate as the variable "rot_speed" to the NC 704. The NC 704 then adjusts the rotational rate of the ADRAM unit 22 to match the "rot_speed" value. That is, the rotation rate of the ADRAM unit 22 is measured as it sprays the refractory material, and is thus an input variable to the first control algorithm. Also, the first control algorithm outputs a desired rotation rate that is used by the NC 704 as described above.

The rise rate (or fall rate) may be entered in inches per minute. Although the term "rise" is used, this variable refers to either upward or downward vertical movement. One way of conducting the repair is to lower the ADRAM unit 22 to the bottom of the vessel. As it applies refractory material, the ADRAM unit 22 may be moved upwards. It is the rate of the upward movement that may be referred to as the rise rate.

The MFO is a figure entered as a percentage (e.g., 200% means twice while 50% means half). The MFO is used by the algorithms as a biasing mechanism that has the effect of manually overriding the gun spraying operation. For example, assuming that the ADRAM unit 22 is turning at one rpm and is applying 300 lbs per minute of material, if suddenly the pumped material increases to 600 lbs per minute, the control program would allow the change of the MFO to accommodate that measured pump rate change in the pumping rate variable. This accommodation is done, again, by changing the MFO, which may have an actual effect on the rise rate, the rotation rate, or both.

In one embodiment of the present invention, the MFO may only change when one of the non-fixed variables changes. Again, assuming a default pump rate of 300 lbs per minute and assuming that the diameter, rotation rate, and rise rate are all known, so that it is known where to spray the material in the vessel, the repair system would run smoothly on its own. In the unlikely event that suddenly the pump rate doubles, then the rise rate and/or the rotation rate would have to be changed via the MFO. Thus the MFO allows for compensation of the variables in the control program: it biases the entire program. In essence, by changing the MFO any change in a variable or in any combination of variables can be compensated for. In sum, the MFO may be seen as an external "gas pedal" which may be used to make the repair system run faster or slower in one of the control areas (e.g., rotation rate or rise rate). If all of the variables used in the control algorithms were not subject to change, then the MFO would not be needed.

Another example of the use of the MFO follows. In the initial programming of the variables, the diameter of the vessel at different elevations is known. Because the diameter of the vessel changes with elevation, the diameter change may be programmed as a change in the variable. At the point where the vessel is twice the diameter of a previous point, it will take twice as long to deposit the same amount of material on the wall equally around. The diameter variable is then entered programmatically or as the diameter changes, the variable may be altered with the MFO.

As mentioned previously, the control program includes two control algorithms. A summary of the algorithms and a discussion of the same follow:

Rotation Rate Control Algorithm (VisualBasic)

```
Rotation_AxisVelocity=WAPIAerReadVelocity in machine
  steps per millisecond divided by ((1.25×10^4)×6000)
  'Velocity in units per minute
Rotation_FeedPos=WAPIAerReadPosition(8)×10^4
furn_data(xfeed,cell)=(material discharge rate in lbs per
  minute divided by (rotational degrees per minute×
  material density), vessel matrix location)
rot_speed=Str((Val(furn_data(xfeed,cell)))×(Rot_MFO_
  scroll.Value×0.01))
SendSuccess&=WAPIAerSend("FR X"+rot_speed)
```

The WAPIA VisualBasic functions are used in the algorithm above for controller communications utilizing WINAER.INC as a VisualBasic module. WINAER.INC is a Visual Basic standard module that contains procedures and declarations commonly accessed by other modules within the application. It contains global and module-level declarations of variables, constants, types, external procedures and global procedures. A generic version of WINAER.INC which is commercially available has been modified for implementing the algorithms of the present invention.

The WAPIAerReadVelocity is the function that queries the controller NC 704 for the rotation rate of the ADRAM unit 22. While the algorithm may be run on the PC 702, the NC 704 measures and provides the actual rotation rate of the ADRAM unit 22. The NC 704 provides that speed in machine steps per millisecond, which in one embodiment of the present invention is divided by the conversion factor (1.25×10^4×6000) in order to convert the rate to degrees per minute.

The Rotation_FeedPos variable uses the WAPIAerReadPosition function to read from the controller the angular position of the ADRAM 22.

The furn_data(xfeed,cell) is a two dimensional variable that refers to the contour of the vessel interior. The contour information is obtained from the cell matrix.

Before proceeding with a detailed explanation of the furn_data variable, it is important to address the significance of the contour information as used in the present invention. If the ADRAM unit 22 were rotating clockwise starting, for example, at 12 o'clock, and it is determined (by examining contour data) that in the 3 to 4 o'clock position the vessel is worn out twice as much as in the 12 to 3 o'clock position, twice as much material has to be deposited for the 3 to 4 o'clock position. The solution may consist of programatically slowing down the rotation rate between the 3 to 4 o'clock position to half the speed, which would double the amount of material that is deposited on the vessel wall. The area covered by the ADRAM unit 22 when the unit is pointing within the 3 to 4 o'clock area is depressed as mentioned before.

The contour requirement in the preceding example may have been to simply restore the wall vessel to its original thickness. The contour requirement may vary so as to require the wall thickness to be more than the original thickness. In general, if the contour is negative, the ADRAM unit 22 slows down (rotation rate) so that more material is deposited. If the contour is positive, meaning that the wall thickness for a certain area is acceptable, then the rotation rate of the ADRAM unit 22 is increased so that it sprays past the area so that a nominal amount of repair refractory material is applied. In essence, the contour information is that information that captures the irregularities in the vessel walls, as provided by the cell matrix. The contour information is input into the algorithm as the variable furn_data.

The variable furn_data is the data extracted from the cell matrix. The pointers xfeed and cell point to the cell matrix. Specifically, "xfeed" points to angular position data while "cell" points to the elevation data. For example, furn_data (1,1) may describe the vessel at an elevation of zero feet and at zero degrees from a reference point. The elevation data may be stored in the cell matrix in inch units or inch increments. The angular position may be stored in the cell matrix in degrees.

The variable rot_speed is used to calculate the desired rotation rate of the ADRAM unit 22. That is, the rot_speed value will be used as part of the signal controlling the rotational movement of the ADRAM unit 22.

The Str function is used to convert a value to a string while the function Val is used to convert a string to a value. In one embodiment of the present invention the controller inputs and outputs string values that need to be converted to numerical values in order to perform mathematical operations. Thus, in the algorithm above a numerical value is converted from the cell matrix and is then multiplied by the MFO. The result is converted back to a string value for input into the controller.

The line starting with "SendSuccess" simply checks that the NC 704 is ready to receive data. If that is the case, the variable rot_speed is sent to the NC 704 so that the rotation rate of the ADRAM 22 may be properly adjusted (if an adjustment is indeed needed). In sum, the first algorithm outputs a desired rotation rate by accounting for variance in vessel diameters and pump rates. Deviations in diameter and pump rate may be modified by changing the MFO.

The rise rate control algorithm reads as follows:

Rise Rate Control Algorithm (VisualBasic)

```
X_AxisVelocity=WAPIAerReadVelocity in machine steps
  per millisecond divided by (3.6036×10^4)×6000'Velocity
  in units per minute
XfeedPos=WAPIAerReadPosition(8)×10^4
no_o_steps=val(JogSpeedTextBox(3).text) 'Up steps text
  box
'JogSpeedTextBox(2) is in inches per step text box
'JogSpeedTextBox(4) step speed in inches per minute
'JogSpeedTextBox(6) is down travel distance in inches
if Bump_done=0 Then
 If steps_to_go=no_o_steps Then
  SendSuccess&=WAPIAerSend("li X"+JogSpeedTextBox
    (6).text|"F"|
  JogSpeedTextBox(4).text)
 steps_to_go=0
 bump_done=1
Else
 SendSuccess&=WAPIAerSend("li X-"+JogSpeedTextBox
  (2).text +"F"+
 JogSpeedTextBox(4).text)
steps_to_go=0
bump_done=1
End If
```

The first two lines of the rise rate algorithm are similar to those in the rotation rate algorithm and therefore will not be fully discussed. The main difference lies in the conversion factor used in the first line. That difference relates to the cable drum. Specifically, the program accounts for the number of motor revolutions it takes to turn the cable drum so that a user screen displays, for example, the number of inches of cable fed out or in. For example, assuming that a user screen displays elevation of the ADRAM unit 22 in inches and the rotation in degrees, the NC 704 is queried and it returns the axis velocity in machine steps per millisecond. That number is then multiplied by conversion constant that accounts for any gear boxes, gearing, and for elevation, the cabledrum. This enables a user to view direct incremental position movement.

The variable no_o_steps refers to the number of steps or times that the refractory material will be sprayed on a given cell area. If in order to achieve the desired wall thickness for a cell area, three inches of material need to be applied in that area, and assuming that the ADRAM unit 22 is putting 1.5 inches of material per time, then the ADRAM unit 22 will have to spray the material over that area twice in order to meet the desired wall thickness.

In order to accomplish this, the rise rate control algorithm makes use of VisualBasic boxes set up on a screen to represent up or down steps of the ADRAM unit 22. In essence, the algorithm takes into account the number of times that the ADRAM unit 22 will go around a particular cell area, and depending on the amount of material applied each time the XDRAM unit 22 goes around, the ADRAM unit 22 may come back and apply more material across that particular cell. The algorithm determines how many times the ADRAM unit 22 has gone up and down in order to determine how much material is needed to be applied. Line 10 of the algorithm includes the term "li X", which relates to an instruction to the controller to move the ADRAM unit 22 down. Conversely, line 15 of the algorithm includes the term "li X-", which relates to an instruction to the controller to move the ADRAM unit 22 up.

Figure 9:
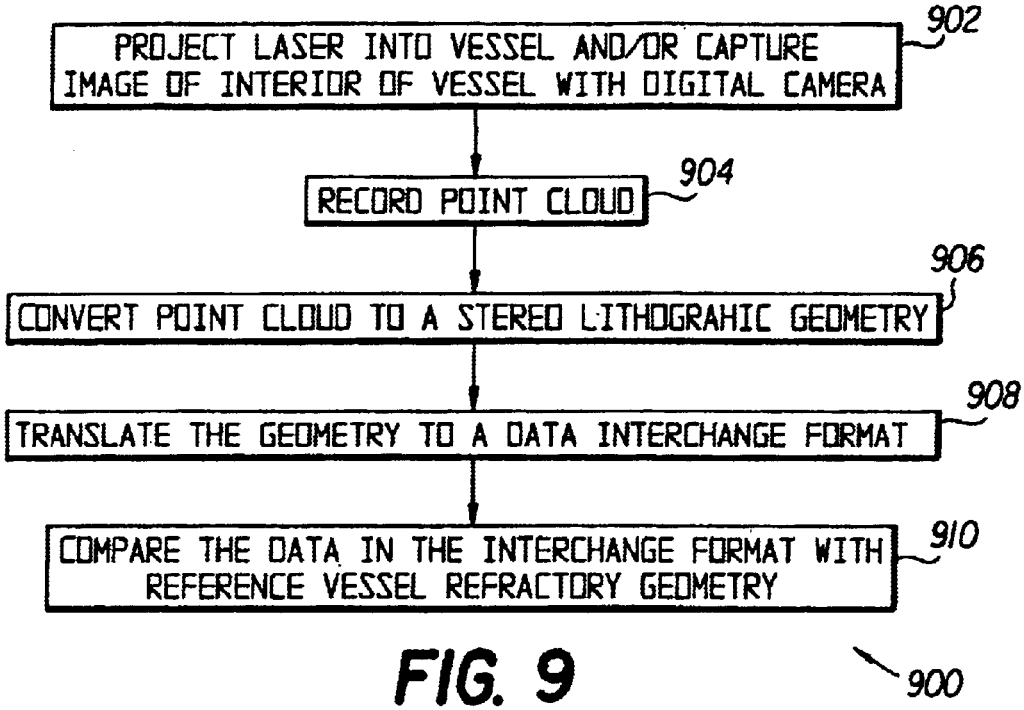
FIG. 9 is a flowchart of a vessel inspection method of the present invention.

FIG. 9 summarizes the method 900 for inspecting the interior of a vessel that was discussed above in detail. The method includes the step 902 of projecting a laser into the vessel and/or capturing the image of the vessel interior walls with the digital camera. The data produced by either the digital camera or by a reading of the reflected laser are of the same kind, i.e., point cloud data. The point cloud data is recorded in step 904.

The method 900 further includes the step of converting the point cloud data into a stereo lithographic geometry. That geometry is then translated into a data interchange format in step 908. Finally, in step 910 the data in the interchange format is compared to a reference geometry of the interior of the vessel. That comparison is later used as part of the vessel repair process so that a user can determine the vessel gunning refractory parameters.

Figure 10:
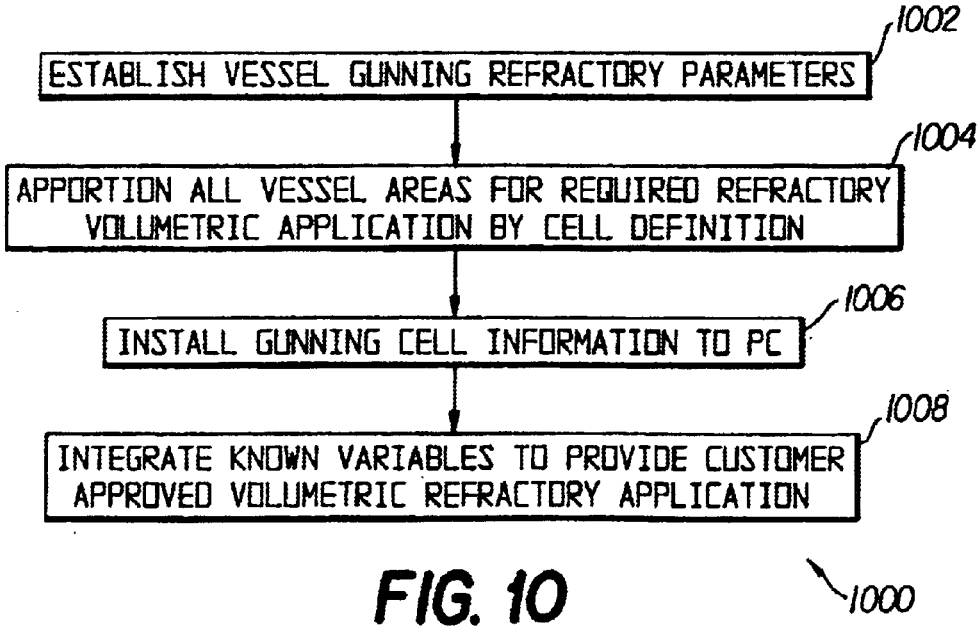
FIG. 10 is a flowchart of a vessel repair method of the present invention.

FIG. 10 summarizes the method 1000 for repairing the interior of a vessel that was discussed above in detail. The method includes the step 1002 of establishing vessel gunning refractory parameters. This step takes place after step 910 in FIG. 9, since after a user sees the exact amount of refractory material that would be needed to bring the walls of the interior of the vessel to the reference thickness, the user may specify vessel gunning refractory parameters in order to vary a default refractory material that would be put back on the worn wall. That is, since only after the geometry of the interior of the vessel is acquired a user would be able to assess the exact amount of material to be sprayed onto the walls, the user may later reduce (or less likely, increase) the actual amount of material to be applied to the vessel by establishing vessel gunning refractory parameters. Using default parameters would result in applying an amount of refractory material that directly corresponds to the difference between the acquired geometry and the reference geometry. In addition to the amount of refractory material to be applied, the parameters may also include the location on which the material is to be applied.

Step 1004 is related to step 1002. After a user establishes the parameters, the next step (1004) is to apportion all vessel areas for refractory volumetric application by cell definition. That is, all areas are divided into cells, as discussed above, but depending on the established vessel gunning refractory parameters, it may be determined that not every cell will be subject to the application of refractory material. Nevertheless, all of the vessel areas are apportioned in order to make that determination.

Step 1006 includes installing gunning cell information to the PC 702. The gunning cell information is derived from the vessel gunning refractory parameters. That is, the gunning cell information refers to the amount of refractory material to be applied to a particular cell. Once this information is installed in the PC 702, the PC 702 in step 1008 implements algorithms to integrate known variables to command the NC 704 to control the application of refractory material according to the vessel gunning refractory parameters.

While this invention has been described in conjunction with the specific embodiments outlined above, it is evident that many alternatives, modifications and variations are apparent to those skilled in the art. Accordingly, the preferred embodiments of the invention as set forth above are intended to be illustrative and not limiting. Various changes may be made without departing from the spirit and scope of the invention.

What is claimed is:

1. A method for repairing a vessel comprising:

establishing gunning parameters;

apportioning vessel areas into cells for gunning refractory material on a per cell basis;

importing gunning cell information for all cells into a computer memory in a single transfer; and integrating vessel variables to control the gunning of the refractory material;

wherein the step of integrating vessel variables comprises solving volumetric specifications derived from variations in vessel diameter and contour, repair material density; and integrating the volumetric specifications with a rate of angular movement of the gun and with repeat pattern adjustments.

2. The method of claim 1, further comprising:

commanding a numerical controller to control the gunning of refractory material according to the gunning parameters.

3. A method for repairing a vessel comprising:

establishing gunning parameters;

apportioning vessel areas into cells for gunning refractory material on a per cell basis;

importing gunning cell information for all cells into a computer memory in a single transfer; and integrating vessel variables to control the gunning of the refractory material;

wherein the step of integrating vessel variables comprises:

integrating repair material density, vessel diameter, desired surface thickness, repair material pump rate, gun rotation rate, gun rise rate, and manual feed override to control the gunning of the repair material.

4. A method for repairing a vessel comprising:

establishing gunning parameters;

apportioning vessel areas into cells for gunning refractory material on a per cell basis;

integrating vessel variables; and controlling a gun for spraying refractory material onto said cells according to the gunning parameters; wherein the step of integrating vessel variables comprises solving volumetric specifications derived from variations in vessel diameter and contour, repair material density, and repair material gunning speed; and integrating the volumetric specifications with a rate of angular movement of the gun and with repeat pattern adjustments.

5. A method for repairing a vessel comprising:

establishing gunning parameters;

apportioning vessel areas into cells for gunning refractory material on a per cell basis;

integrating vessel variables; and controlling a gun for spraying refractory material onto said cells according to the gunning parameters wherein the step of integrating vessel variables comprises:

integrating repair material density, vessel diameter, desired surface thickness, repair material pump rate, gun rotation rate, gun rise rate, and manual feed override to control the gunning of the repair material.

6. The method of claim 4, wherein the step of establishing gunning parameters comprises establishing a preferred volumetric refractory material usage for each cell.

7. The method of claim 4, wherein the step of establishing gunning parameters comprises:

obtaining data corresponding to the surface of the vessel;

comparing said data with reference vessel characteristics to establish deficiencies in the vessel surface; and generating a data matrix corresponding to said deficiencies.

8. The method of claim 4, wherein the step of integrating vessel variables comprises:

calculating a desired rotation rate of the gun based on the gunning parameters.

9. The method of claim 4, wherein the step of integrating vessel variables comprises:

using a gun angular position as an index to access contour data from a data matrix; and calculating a desired gun rotation rate based on said contour data.

10. The method of claim 4, wherein the step of integrating vessel variables comprises:

obtaining a rotation rate of the gun;

obtaining an angular position of the gun;

accessing contour data from a data matrix; and calculating a desired rotation rate of the gun based on the contour data and a manual feed override parameter.

11. The method of claim 4, wherein the step of controlling the gun comprises adjusting the gun rotation rate to match the desired rotation rate.

* * * * *